US009979075B2

(12) United States Patent
Koyama et al.

(10) Patent No.: US 9,979,075 B2
(45) Date of Patent: May 22, 2018

(54) ANTENNA DEVICE AND ELECTRONIC TIMEPIECE

(71) Applicant: Seiko Epson Corporation, Tokyo (JP)

(72) Inventors: Shunsuke Koyama, Chino (JP); Jun Matsuzaki, Shiojiri (JP)

(73) Assignee: Seiko Epson Corporation (JP)

( * ) Notice: Subject to any disclaimer, the term of this patent is extended or adjusted under 35 U.S.C. 154(b) by 122 days.

(21) Appl. No.: 15/040,261

(22) Filed: Feb. 10, 2016

(65) Prior Publication Data

US 2016/0240913 A1 Aug. 18, 2016

(30) Foreign Application Priority Data

Feb. 13, 2015 (JP) ..... 2015-026181

(51) Int. Cl.

| | |
|---|---|
| ***H01Q 1/12*** | (2006.01) |
| ***H01Q 1/27*** | (2006.01) |
| ***G04R 60/12*** | (2013.01) |
| ***H01Q 1/22*** | (2006.01) |
| *H01Q 9/30* | (2006.01) |

(52) U.S. Cl.

CPC ..... *H01Q 1/273* (2013.01); *G04R 60/12* (2013.01); *H01Q 1/12* (2013.01); *H01Q 1/2283* (2013.01); *H01Q 9/30* (2013.01)

(58) Field of Classification Search

USPC ..... 343/720, 718

See application file for complete search history.

(56) References Cited

U.S. PATENT DOCUMENTS

| | | | | |
|---|---|---|---|---|
| 8,421,679 | B2 * | 4/2013 | Suzuki | H01Q 1/243 343/700 MS |
| 8,456,949 | B2 | 6/2013 | Cambois | |
| 8,467,272 | B2 | 6/2013 | Fujisawa | |
| 8,570,840 | B2 | 10/2013 | Fujisawa | |
| 8,665,675 | B2 | 3/2014 | Fujisawa | |
| 8,755,253 | B2 | 6/2014 | Fujisawa | |
| 8,942,068 | B2 | 1/2015 | Fujisawa | |
| 9,116,512 | B2 | 8/2015 | Fujisawa | |
| 2012/0188123 | A1 * | 7/2012 | Baba | G04C 10/02 342/357.63 |
| 2013/0077451 | A1 * | 3/2013 | Kojima | G04C 10/02 368/205 |
| 2014/0126337 | A1 | 5/2014 | Fujisawa | |

(Continued)

FOREIGN PATENT DOCUMENTS

| | | | |
|---|---|---|---|
| JP | 2000-059241 | A | 2/2000 |
| JP | 2003-152582 | A | 5/2003 |

(Continued)

*Primary Examiner* — Jessica Han
*Assistant Examiner* — Hai Tran
(74) *Attorney, Agent, or Firm* — Harness, Dickey & Pierce, P.L.C.

(57) ABSTRACT

An antenna device housed in a metallic case body of an electronic timepiece includes: a first substrate which is provided on the side of a back over of the metallic case body and on which a ground pattern and an wireless communication unit as a power feeding circuit are formed; a second substrate which is arranged on the opposite side of the movement and on which a chip antenna is formed; and a conductive electrode which is arranged inside the movement and has one end connected to the wireless communication unit and the other end connected to the chip antenna.

9 Claims, 15 Drawing Sheets

(56) References Cited

U.S. PATENT DOCUMENTS

| | | | | |
|---|---|---|---|---|
| 2014/0241131 | A1* | 8/2014 | Honda | G04C 10/02<br>368/47 |
| 2015/0323907 | A1 | 11/2015 | Fujisawa | |

FOREIGN PATENT DOCUMENTS

| | | | |
|---|---|---|---|
| JP | 2009-168656 | A | 7/2009 |
| JP | 2011-021929 | A | 2/2011 |
| JP | 2011-066648 | A | 3/2011 |
| JP | 2012-093211 | A | 5/2012 |
| JP | 2012-233926 | A | 11/2012 |
| JP | 2013-040793 | A | 2/2013 |
| JP | 2013-205333 | A | 10/2013 |
| JP | 2013-217938 | A | 10/2013 |

* cited by examiner

ANTENNA DEVICE AND ELECTRONIC TIMEPIECE

BACKGROUND

1. Technical Field

The present invention relates to an antenna device and an electronic timepiece.

2. Related Art

As a near-field wireless communication technique between electronic devices, Bluetooth (trademark registered) is known. For example, an electronic timepiece which performs wireless communications between an electronic device and the timepiece according to the Bluetooth (trademark registered) standard is disclosed (JP-A-2003-152582).

However, according to the technique of JP-A-2003-152582, since the chip antenna is arranged at a position different from the circuit board, miniaturization is difficult and the structure is complex. Also, according to the technique of JP-A-2003-152582, the casing is formed of a non-conductive member and the use of a metallic case is not assumed. Thus, it is hard to say that, in the case where an antenna is arranged inside a metallic case, problems with the configuration are solved in terms of whether sufficient measures can be taken to prevent deterioration in antenna properties due to the antenna being surrounded by the metal, and deterioration in properties due to the proximity between the antenna and the battery and the contact or proximity between the antenna and the case or the like.

SUMMARY

An advantage of some aspects of the invention is to provide an antenna that can be installed inside an electronic timepiece having a metallic case and pointers, particularly an antenna device having good properties in areas of use such as the 2.4-GHz band (Bluetooth (trademark registered)) and WiFi (trademark registered), and an electronic timepiece having the antenna device.

An antenna device according to an aspect of the invention is an antenna device housed in a metallic case of an electronic timepiece and including: a first substrate which is arranged between a movement of the electronic timepiece arranged inside the metallic case and a back cover of the metallic case and on which a ground pattern and a power feeding circuit are formed; a second substrate which is attached to the movement and arranged at a position sandwiching the movement of the electronic timepiece with the first substrate and on which an antenna element is formed; and a conductive electrode which is arranged inside the movement and has one end connected to the power feeding circuit and the other end connected to the antenna element.

In the antenna device according to this aspect, the antenna is three-dimensionally formed by the antenna element on the second substrate, the conductive electrode, and the ground pattern on the first substrate. Therefore, deterioration in antenna properties and deterioration in gain can be reduced. Also, since the second substrate with the antenna element formed thereon is arranged at a position apart from the back cover of the metallic case by the amount of the thicknesses of the first substrate and the movement, the influence from the back cover of the metallic case with a relative large area can be reduced and deterioration in antenna gain can be reduced. Moreover, since the second substrate with the antenna element formed thereon is attached to the movement, variance in antenna position is reduced and consequently variance in gain is reduced.

In the antenna device, on the second substrate, a ground pattern may be formed with a predetermined distance maintained from the antenna element, and the ground pattern on the second substrate may be electrically continued to the ground pattern on the first substrate. In this case, since the ground pattern is formed on the second substrate as well, good directionality of the antenna is achieved.

In the antenna device, the first substrate may include a plurality of layers, and the ground pattern on the first substrate may be formed on at least one layer of the first substrate and formed in the entire area of the first except the power feeding circuit and a connecting part between the power feeding circuit and the conductive electrode. In this case, since the ground pattern is formed on each layer, good directionality of the antenna is achieved.

In the antenna device, the ground pattern may have an electric potential equal to a positive potential or a negative potential of a battery of the electronic timepiece. In this case, deterioration in antenna properties is reduced by utilizing a typical configuration of electronic timepiece.

In the aspect of the invention, the term "entire area" is a concept including a substantially entire area.

In the antenna device, the movement may be attached to the metallic case via a middle frame. In this case, since the movement is attached with a predetermined clearance provided by the middle frame from the metallic case, the antenna element attached to the movement is similarly arranged with a predetermined clearance from the metallic case. Consequently, variance in antenna gain is restrained and ease of assembly is improved as well.

In the antenna device, the middle frame may be positioned by a dial ring. In this case, since the middle frame is attached with a predetermined clearance in the direction of the thickness of the metallic case by the dial ring, the antenna element attached to the movement is similarly arranged with a predetermined clearance in the direction of the thickness of the metallic case. Consequently, variance in antenna gain is restrained and ease of assembly is improved as well.

In the antenna device, the antenna element may be a chip antenna. In this case, a basic antenna element that can be easily formed can be used.

In the antenna device, the antenna element may be a printed pattern. In this case, a basic element that can be easily formed can be used.

The invention can also be understood as an electronic timepiece having the antenna device. This electronic timepiece is provided as an electronic timepiece with less deterioration in antenna properties and less deterioration in gain even if a metallic case is used.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described in detail, referring to the accompanying drawings. However, in each illustration, the dimensions and scales of individual parts are made different from the actual dimensions and scales according to need. Also, while the embodiments described below are preferred specific examples of the invention and therefore give various technically preferred limitations, the scope of the invention is not limited to these examples unless the description that the invention should be particularly limited is given below.

First Embodiment

Figure 1:
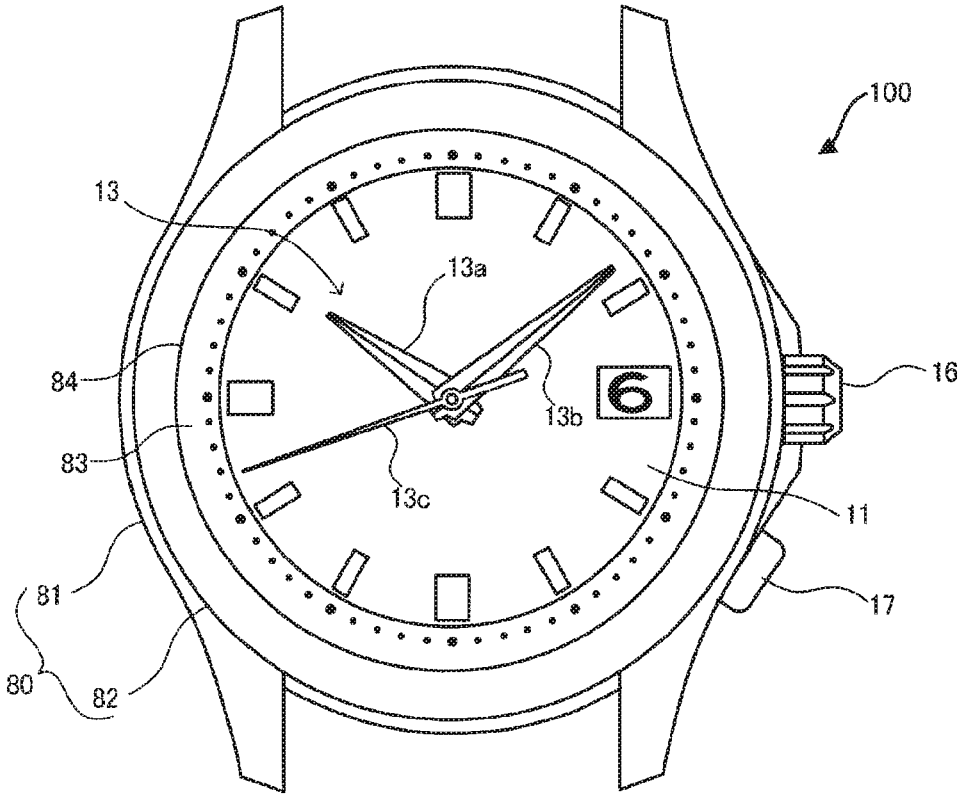
FIG. 1 is a plan view showing the appearance of an electronic timepiece according to a first embodiment of the invention.
Figure 2:
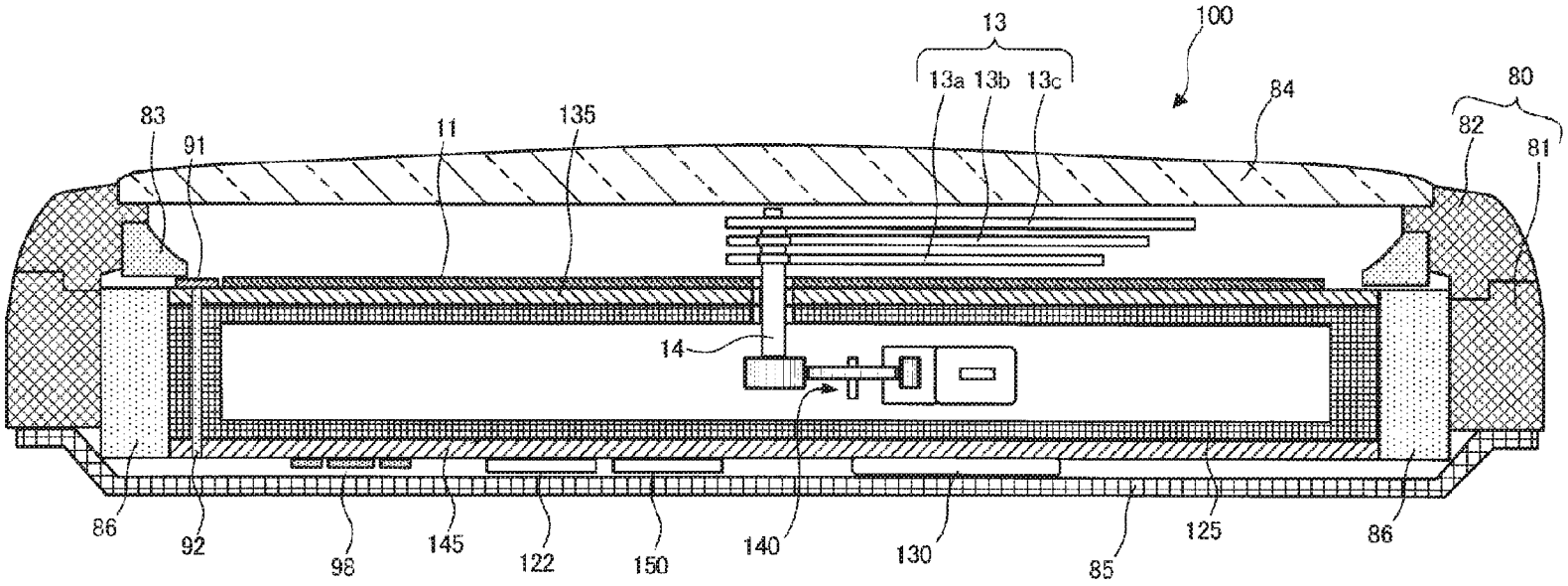
FIG. 2 is a cross-sectional view showing the physical structure of the electronic timepiece.

A first embodiment of the invention will be described, referring to FIGS. 1 and 2. FIG. 1 is a plan view showing the appearance of an electronic timepiece according to the embodiment. FIG. 2 is a partial cross-sectional view schematically showing the electronic timepiece.

A: Outline of Electronic Timepiece

An electronic timepiece 100 is an electronic timepiece capable of near-field wireless (Bluetooth (trademark registered) or the like) communications using the 2.4-GHz band (ISM band).

As shown in FIGS. 1 and 2, the electronic timepiece 100 has an exterior case 80. The exterior case 80 is made up of a cylindrical case body 81 formed of a metal, with a bezel 82 formed of a ceramic or metal fitted in the case body 81. While the exterior case is made up of two parts in the embodiment, the exterior case may be made up of one component.

On the inner circumferential side of the bezel 82, a disc-like face 11 is arranged via a ring-shaped dial ring 83. On this face 11, pointers 13 indicating time, and a calendar or the like is arranged. The pointers 13 include an hour hand 13*a*, a minute hand 13*b*, and a second hand 13*c*.

An opening on the face side of the exterior case 80 is closed by a glass cover 84 via the bezel 82. The face 11 and the pointers 13 (hour hand 13*a*, minute hand 13*b*, and second hand 13*c*) inside the opening are visible through the glass cover 84.

The electronic timepiece 100 is configured in such a way that manual time correction can be made by manually operating a crown 16 and that switching between a normal time display mode and a communication mode can be made by manually operating an operation button 17.

As shown in FIG. 2, in the electronic timepiece 100, the opening on the face side, of the two openings of the metallic exterior case 80, is closed by the glass cover 84 via the bezel 82, and the opening on the back side is closed by a back cover 85 formed of a metal.

The dial ring 83 has a parallel plate part whose outer circumferential end contacts the inner circumferential surface of the bezel 82 and which is parallel to the glass cover 84, and a tilted part tilted toward the face 11 so that the inner circumferential end contact the face 11. The dial ring 83 is ring-shaped when viewed in a plan view, and in the shape of a tapered bowl when viewed in a cross-sectional view.

A second substrate 135 is provided between the face 11 and a movement 125 with a drive mechanism 140 attached thereto. On the second substrate 135, a chip antenna 91 as an antenna element, a power feeding pattern 94, and a connecting point 93 are provided (see FIGS. 5A and 5B). The second substrate 135 is attached to the movement 125 with a screw (not shown) or the like.

The movement 125 is made up of a plastic component and has the drive mechanism 140 provided inside. The drive mechanism 140 has a stepper motor and a gear train including gears or the like. As the stepper motor causes a pointer shaft 14 to rotate via the gear train, the pointers 13 are driven.

In the embodiment, a fixed ring-shaped middle frame 86 is attached to the outer circumference of the movement 125. Positioning in the radial direction is performed with the middle frame 86 and the case body 81, and positioning in the vertical direction is performed with the middle frame 86 and the dial ring 83.

On the back side of the movement 125, a first substrate 145 is attached to the movement 125 with a screw (not shown) or the like. The first substrate 145 has a communication unit 122, a control unit 150, and a battery 130. The first substrate 145 also has a connecting point 95, a power feeding pattern 96, a matching element 98, and a power feeding point 97 (see FIG. 5D).

A through-hole is formed in the second substrate 135, the movement 125 and a part of the first substrate. A conductive electrode 92 is arranged in this through-hole. The conductive electrode 92 is connected to the chip antenna 91 via the connecting point 93 and the power feeding pattern 94 on the second substrate 135 and is also connected to the power feeding point 97 via the connecting point 95 and the power feeding pattern 96 on the first substrate. Details will be described later.

B: Electrical Configuration of Electronic Timepiece

Figure 3:
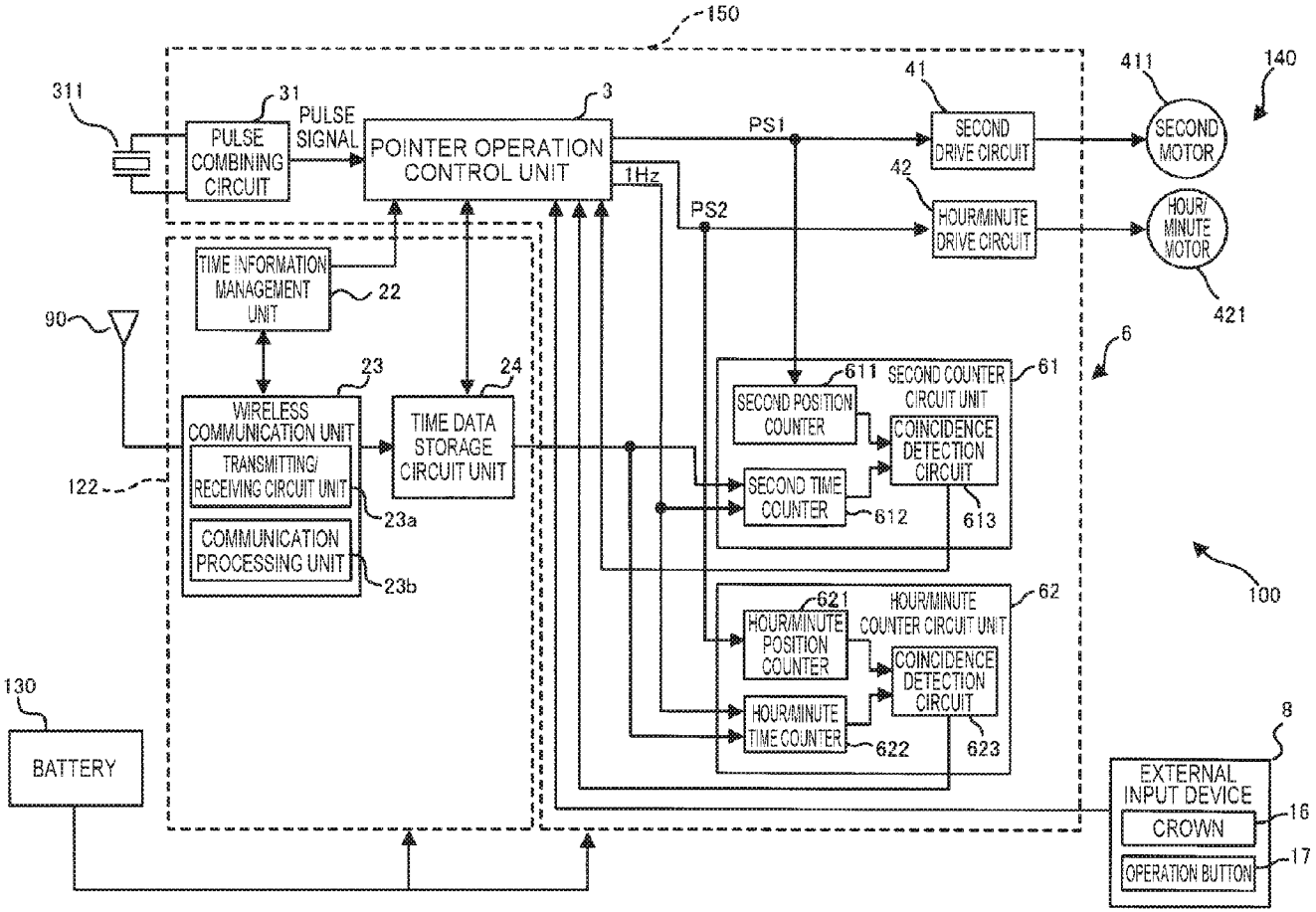
FIG. 3 is a block diagram showing the electrical configuration of the electronic timepiece.

The electronic timepiece 100 includes the communication unit 122 which performs wireless communications according to the Bluetooth (trademark registered) standard, the control unit 150 which controls the driving of the pointers, the drive mechanism 140 which drives the pointers, the battery 130, and an external input device 8 including the crown 16 and the operation button 17 or the like, as shown in FIG. 3.

The communication unit 122 includes an antenna device 90, a time information management unit 22, a wireless communication unit 23, and a time data storage circuit unit 24. In the embodiment, the communication unit 122 performs wireless communications according to the Bluetooth (trademark registered) standard and therefore uses frequencies in the 2.4-GHz band.

The antenna device 90 is made up of the chip antenna 91 as an antenna element, the conductive electrode 92, and the power feeding point 97 or the like. Details will be described later.

The time information management unit 22 is realized by a CPU or the like and performs processing of correcting the present time to the time based on time information acquired via wireless communications with an external electronic device. The time information management unit 22 also performs processing to transmit the present time of the electronic timepiece 100 to a mobile device via wireless communications with an electronic device. Details will be described later.

The wireless communication unit 23 is realized by a dedicated IC (integrated circuit device) which performs wireless communications according to the Bluetooth (trademark registered) standard. The wireless communication unit 23 has a transmitting/receiving circuit unit 23*a* including a tuning unit made up of a capacitor or the like and a power amplifier, and a communication processing unit 23*b* including a link layer unit and a control processing unit. The transmitting/receiving circuit unit 23*a* performs wireless transmission and reception of information with an electronic device. The link layer unit of the communication processing unit 23*b* performs processing of a link layer, that is, processing related to logical connection between devices. The functions of the control processing unit of the communication processing unit 23*b* can be realized by a hardware circuit such as various processors such as CPU or ASIC, or by a program or the like operating on this hardware circuit.

The time data storage circuit unit 24 is made up of a memory or the like and stores time data processed by the wireless communication unit 23.

A pointer operation control unit 3 forming the control unit 150 has a pulse signal inputted thereto from a pulse combining circuit 31, as shown in FIG. 3. The pulse combining circuit 31 divides the frequency of a reference pulse from a reference oscillator 311 such as a crystal oscillator and thus generates a clock pulse, and also generates a pulse signal with a different pulse width and timing from the reference pulse. When in a normal mode, the pointer operation control unit 3 controls the driving of the pointers for normal time display on the basis of the time information outputted from the time information management unit 22, the clock pulse and the pulse signal.

When in the normal mode, the pointer operation control unit 3 outputs a second drive pulse signal which is outputted every second and drives the second hand and an hour/minute drive pulse which is outputted every minute and drives the hour and minute hands, to a second drive circuit 41 and an hour/minute drive circuit 42, respectively, thus controlling the driving of the pointers. That is, the respective drive circuits 41, 42 drive a second motor 411 and an hour/minute motor 421 made up of stepper motors driven by the pulse signals from the respective drive circuits 41, 42, and thus drive the second hand 13*c*, and the minute hand 13*b* and the hour hand 13*a* connected to the respective motors 411, 421. The pointers, the motors 411, 421, and the drive circuits 41, 42 form a time display unit which displays time. Also, as the time display unit, the hour hand, the minute hand and the second hand may be driven by one motor.

A counter unit 6 forming the control unit 150 has a second counter circuit unit 61 which counts seconds, and an hour/minute counter circuit unit 62 which counts hours and minutes.

The second counter circuit unit 61 has a second position counter 611, a second time counter 612, and a coincidence detection circuit 613. The second position counter 611 and the second time counter 612 are both counters which loop on a 60-count basis, that is, on a 60-second basis if a 1-Hz signal is inputted. The second position counter 611 counts drive pulse signals (second drive pulse signal PS1) supplied from the pointer operation control unit 3 to the second drive circuit 41. That is, the second position counter 611 counts drive pulse signals to drive the second hand and thus counts the position of the secondhand shown by the second hand.

The second time counter 612 normally counts 1-Hz reference pulse signals (clock pulses) outputted from the pointer operation control unit 3. Also, if a time correction instruction is outputted from the time information management unit 22, the pointer operation control unit 3 reads time data from the time data storage circuit unit 24 and corrects the counter value according to the second data of this time data.

Similarly, the hour/minute counter circuit unit 62 has an hour/minute position counter 621, an hour/minute time counter 622, and a coincidence detection circuit 623. The hour/minute position counter 621 and the hour/minute time counter 622 are both counters which loop when signals corresponding to 24 hours are inputted. The hour/minute position counter 621 counts drive pulse signals (hour/minute drive pulse signal PS2) supplied from the pointer operation control unit 3 to the hour/minute drive circuit 42 and thus counts the positions of the hour and minute hands shown by the hour and minute hands.

The hour/minute time counter 622 normally counts 1-Hz pulses (clock pulses) outputted from the pointer operation control unit 3 (defines one count when 1 Hz is counted 60 times, to be more precise). Also, if a time correction instruction is outputted from the time information management unit 22, the pointer operation control unit 3 reads time data from the time data storage circuit unit 24 and corrects the counter value according to the hour/minute data of this time data.

The respective coincidence detection circuits 613, 623 detect the coincidence between the counter values of the respective position counters 611, 621 and the respective time counters 612, 622 and output a detection signal indicating whether the counter values coincide with each other or not, to the pointer operation control unit 3.

If non-coincidence signals are inputted from the respective coincidence detection circuits 613, 623, the pointer operation control unit 3 continues outputting the respective drive pulse signals until coincidence signals are inputted. Therefore, in normal pointer operation, when the counter values of the respective time counters 612, 622 change and no longer coincide with the position counters 611, 621 on the basis of the 1-Hz reference signal from the pointer operation control unit 3, the respective drive pulse signals are outputted to move the respective pointers and the respective position counters 611, 621 coincide with the time counters 612, 622. By repeating this operation, normal pointer operation control is performed.

Also, when the respective time counters 612, 622 are corrected on the basis of the time data read from the time data storage circuit unit 24, the respective drive pulse signals continue being outputted until the counter values of the respective position counters 611, 621 coincide with the counter values of the time counters, and therefore the pointers are fast-forwarded to the correct time.

The battery 130 supplies electricity to the communication unit 122 and the control unit 150. As the battery 130, a primary battery such as a silver oxide battery may be used, or a secondary battery such as a lithium ion battery may be used.

The external input device 8 has the crown 16 and the operation button 17 and is used to perform the receiving operation and time setting or the like. The switching between the normal mode and the communication mode is performed by pressing the operation button 17.

C: Configuration of Antenna Device in Electronic Timepiece

Next, the configuration of the antenna device 90 in the electronic timepiece 100 will be described, referring to FIGS. 4A to 6.

Figure 4A:
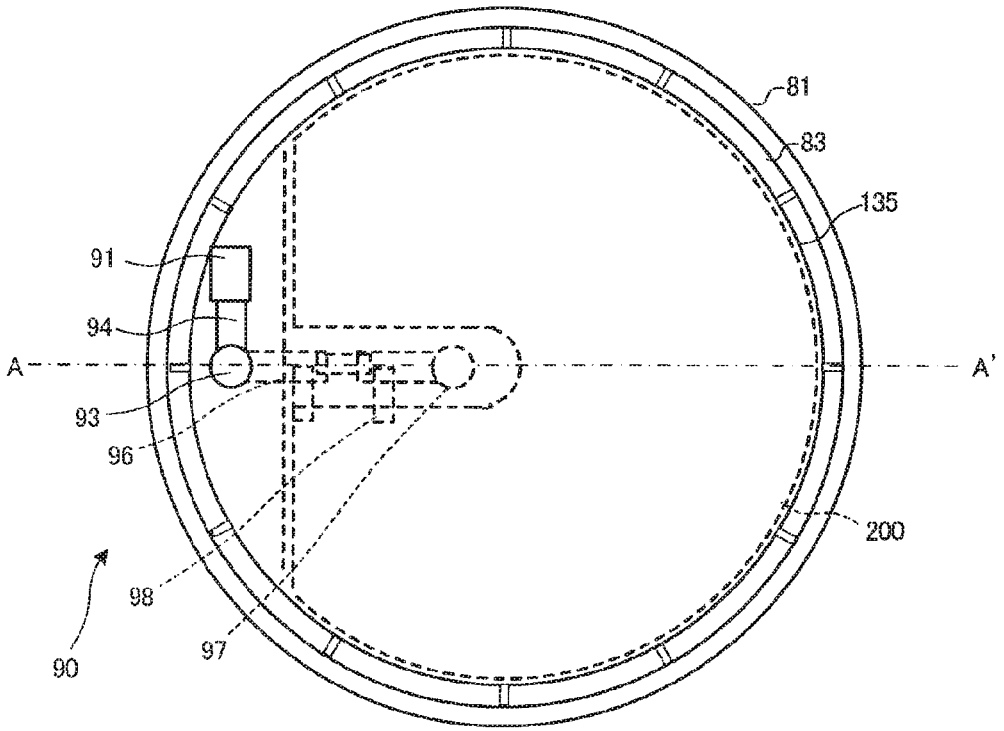
FIG. 4A is a plan view of an antenna device of the electronic timepiece.
Figure 4B:
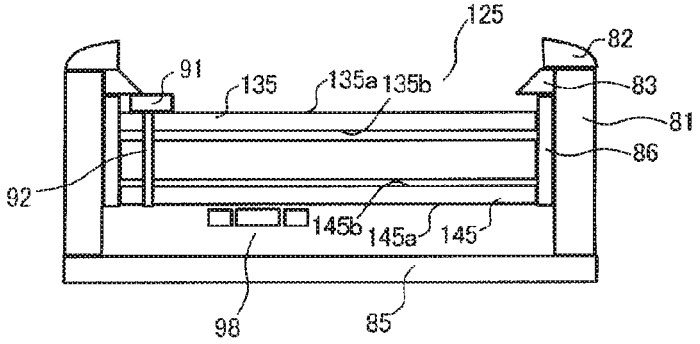
FIG. 4B is a cross-sectional view taken along A-A' in FIG. 4A.
Figure 5A:
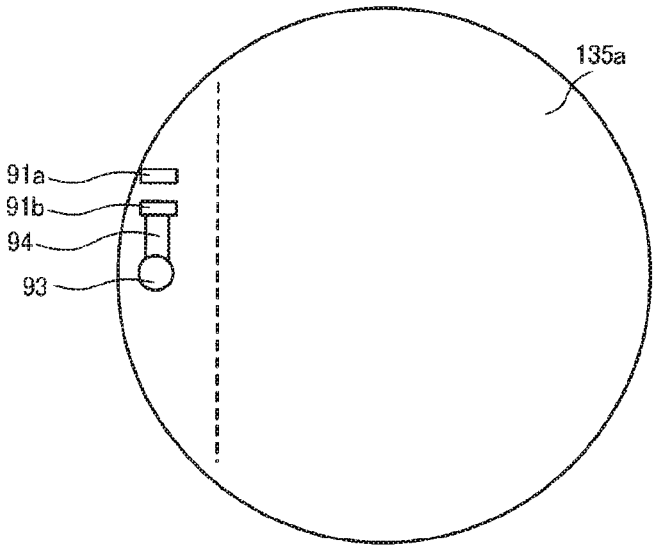
FIG. 5A is a plan view showing the face side of a second substrate of the antenna device.
Figure 5B:
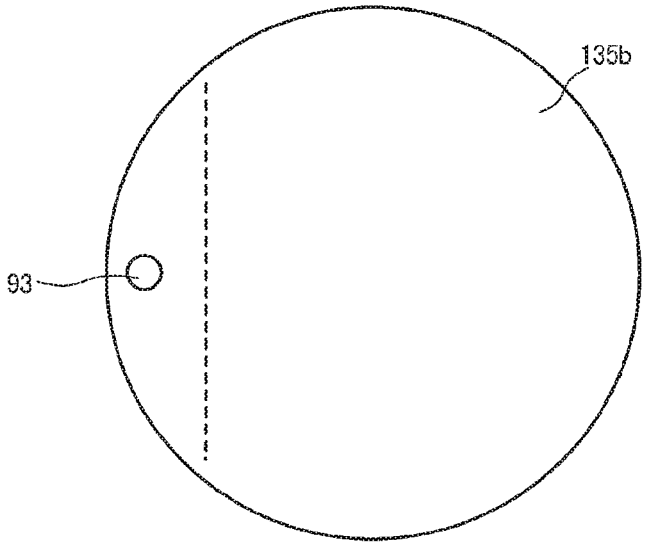
FIG. 5B is a plan view showing the back side of the second substrate of the antenna device.
Figure 5C:
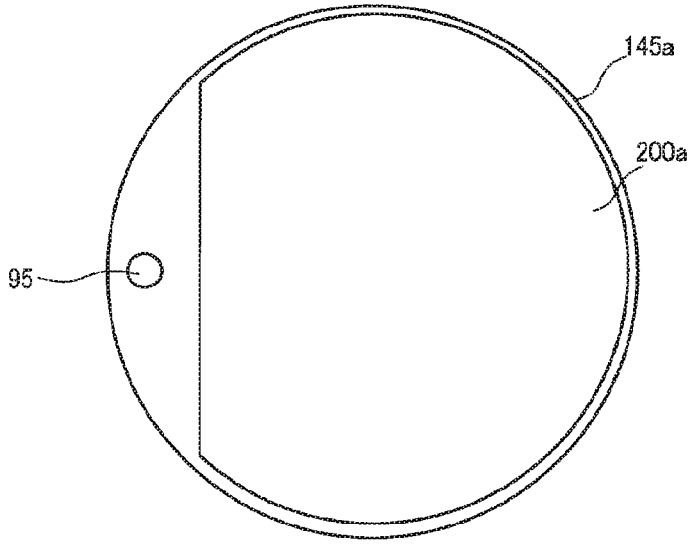
FIG. 5C is a plan view showing the face side of a first substrate of the antenna device.
Figure 5D:
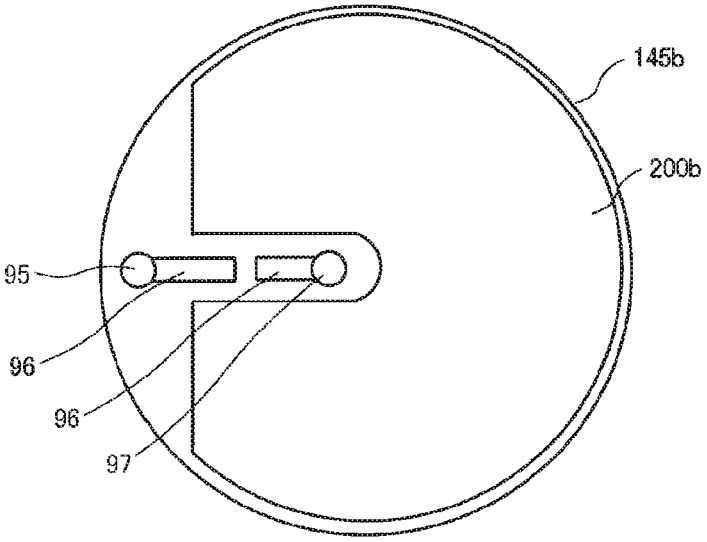
FIG. 5D is a plan view showing the back side of the first substrate of the antenna device.
Figure 6:
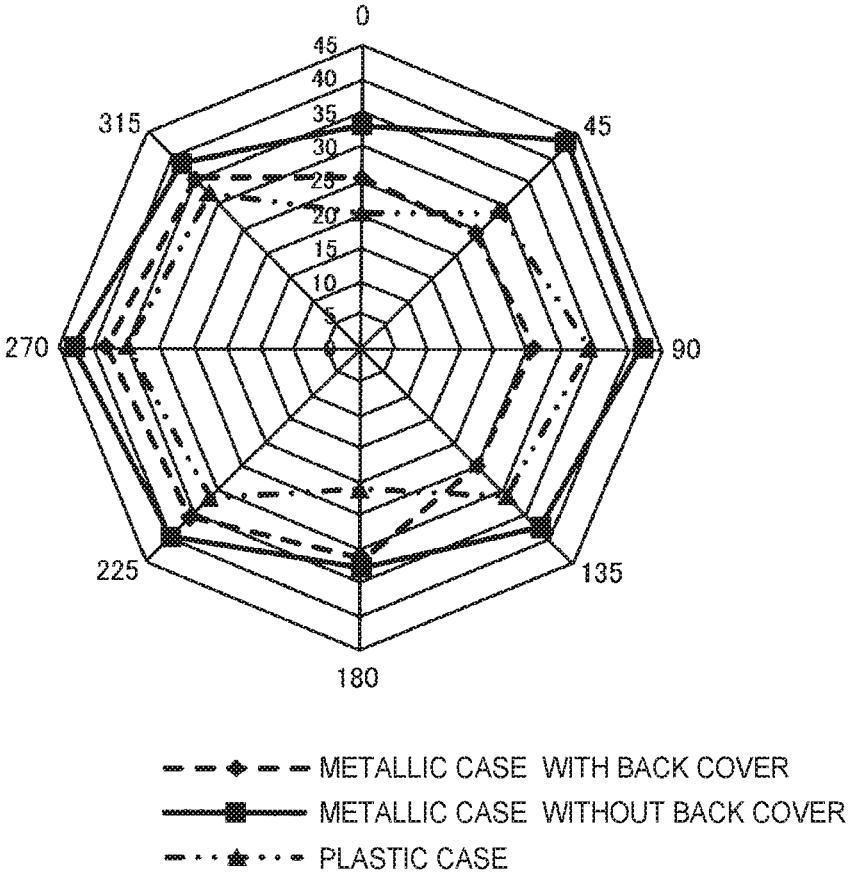
FIG. 6 shows an example of properties of the antenna device.

FIG. 4A is a plan view of the antenna device 90, as viewed from the side of the glass cover 84. FIG. 4B is a cross-sectional view taken along A-A' in FIG. 4A. FIG. 5A is a plan view showing the face side of the second substrate 135. FIG. 5B is a plan view showing the back side. FIG. 5C is a plan view showing the face side of the first substrate 145. FIG. 5D is a plan view showing the back side. FIG. 6 shows an example of properties of the antenna device 90. In the embodiment, when the second substrate 135, the movement 125, and the first substrate 145 are housed in the case body 81 as shown in FIG. 4B, the surfaces on the side of the glass cover 84, of the surfaces of the second substrate 135, the movement 125, and the first substrate 145, are referred to as the face side, and the surfaces on the side of the back cover 85 are referred to as the back side.

The antenna device 90 in the embodiment has the first substrate 145 provided on the side of the metallic back cover 85 attached to the metallic case body 81, and the second substrate 135 arranged on the opposite side of the movement 125 to the first substrate 145.

Of the first substrate 145, only the part related to the antenna device is described as a double-sided substrate (two-layer substrate) in the description referring to FIG. 5C and subsequent drawings. On a face side 145*a* of the first substrate 145 that contacts the back side of the movement 125, a face-side ground pattern 200*a* forming a ground pattern 200, and the connecting point 95 to which the conductive electrode 92 is attached, are formed, as shown in FIG. 5C. The connecting point 95 is a pattern formed of an electrically conductive material and may be a conductive pattern on the inner surface side of the through-hole through which the conductive electrode 92 is inserted, or may be a flat conductive pattern which the end surface of the conductive electrode 92 contacts.

On a back side 145*b* of the first substrate 145 that faces the back cover 85, the connecting point 95, the power feeding pattern 96, the power feeding point 97, and a back-side ground pattern 200*b* forming the ground pattern 200 are formed, as shown in FIG. 5D. The connecting point 95 is a pattern formed of an electrically conductive material and electrically continues to the connecting point 95 on the face side 145*a* of the first substrate 145. Again, the connecting point 95 on the back side 145*b* of the first substrate 145 may be formed as a conductive pattern on the inner surface side of the through-hole through which the conductive electrode 92 is inserted, or may be a flat conductive pattern. The power feeding pattern 96 is a pattern formed of an electrically conductive material and is connected to each of the connecting point 95 and the power feeding point 97. The matching element 98 having a π-type three-element configuration is connected to the power feeding pattern 96, as shown in FIG. 4A. The power feeding point 97 is an input/output point of a circuit connected to the antenna and is connected to the wireless communication unit 23 as a wireless signal power feeding circuit for the antenna device 90 (not shown in FIGS. 4A and 5D). Also, the back-side ground pattern 200*b* and the face-side ground pattern 200*a* are electrically continued to each other.

On a face side 135*a* of the second substrate 135 that faces the glass cover 84, chip antenna attachment patterns 91*a*, 91*b*, the power feeding pattern 94, and the connecting point 93 are formed, as shown in FIG. 5A. The chip antenna attachment patterns 91*a*, 91*b* are formed of an electrically conductive material, and the chip antenna 91 is connected to the chip antenna attachment patterns 91*a*, 91*b*, as shown in FIG. 4A. The connecting point 93 is a pattern formed of an electrically conductive material and may be formed as a conductive pattern on the inner surface side of the through-hole through which the conductive electrode 92 is inserted, or may be a flat conductive pattern which the end surface of the conductive electrode 92 contacts. The power feeding pattern 94 is a pattern formed of an electrically conductive material and is connected to each of the chip antenna attachment pattern 91*b* and the connecting point 93.

On a back side 135*b* of the second substrate 135 that contacts the face side of the movement 125, the connecting point is formed. The connecting point 93 is electrically continued to the connecting point 93 on the face side 135*a* of the second substrate 135. Again, the connecting point 93 on the back side 135*b* of the second substrate 135 may be formed as a conductive pattern on the inner surface side of the through-hole through which the conductive electrode 92 is inserted, or may be a flat conductive pattern.

The first substrate 145 and the second substrate 135 are attached to the movement 125 with screws (not shown) or the like, and the movement 125 is sandwiched between the first substrate 145 and the second substrate 135. As shown in FIG. 4B, the conductive electrode 92 penetrating the first substrate 145, the second substrate 135 and the movement 125 is arranged. One end of the conductive electrode 92 is connected to the connecting point 93 on the second substrate 135, and the other end of the conductive electrode 92 is connected to the connecting point 95 on the first substrate 145.

Thus, the chip antenna 91, the power feeding pattern 94, the connecting point 93, the conductive electrode 92, the connecting point 95, the power feeding pattern 96, the matching element 98, and the power feeding point 97 are electrically continued. Also, the peripheries of the power feeding pattern 96, the matching element 98, and the power feeding point 97 are surrounded by the ground pattern 200 (face-side ground pattern 200*a*, back-side ground pattern 200*b*). These components form the antenna device 90 according to the embodiment of the invention.

That is, the antenna device 90 according to the embodiment of the invention is an antenna device housed inside the metallic case body 81 of the electronic timepiece 100, and includes the first substrate 145 which is provided on the side of the back cover 85 of the metallic case body 81 and on which the ground pattern 200 and the wireless communication unit 23 as the power feeding circuit are formed, the second substrate 135 which is arranged on the opposite side of the movement 125 of the electronic timepiece 100 to the first substrate and on which the chip antenna 91 as an antenna element is formed, and the conductive electrode 92 which is arranged inside the movement 125 and which has one end connected to the wireless communication unit 23 as the power feeding circuit via the power feeding point 97 and has the other end connected to the chip antenna 91 as an antenna element, with the components 91 to 96 forming a monopole to the ground pattern 200.

According to the configuration as described above, in the antenna device 90, the first substrate 145 including the ground pattern 200 and the wireless communication unit 23 as the power feeding circuit is arranged on the side of the back cover 85, and the chip antenna 91 as an antenna element is arranged on the second substrate 135. The wireless communication unit 23 and the chip antenna 91 are electrically continued by the conductive electrode 92 penetrating the two substrates. Therefore, the antenna device can be three-dimensionally formed in a limited space of the case body 81 of the electronic timepiece 100.

This three-dimensional configuration can be realized without adding any large structural change to the mechanical components used in the electronic timepiece 100 and the metallic case body 81. The invention provides the new antenna device 90 that can be arranged in the small-sized metallic case body 81. First, the chip antenna 91 as an antenna element is arranged on the side of the glass cover 84 and spaced apart from the metallic back cover 85 with a large area. Also, the chip antenna 91 as an antenna element is arranged on the top surface of the mechanical components inside the movement 125. Therefore, the influence of the metallic members can be reduced and deterioration in antenna gain is reduced.

Since the conductive electrode 92 has a three-dimensional configuration upright with respect to the first substrate 145, the second substrate 135 and the ground pattern 200, good antenna properties are achieved. Even in a structure where the movement 125 and the metallic back cover 85 are close to each other, a structure with less deterioration in gain can be provided. Moreover, since the wireless communication unit 23 as the power feeding circuit can be provided on the side of the battery 130, the circuit configuration is made easier. Also, since the chip antenna 91 as an antenna element is formed on the second substrate 135 and the second substrate 135 is fixed to the movement 125, and since the conductive electrode 92 is included in the movement 125 as well, variance in antenna position can be reduced. Consequently, variance in antenna gain can be reduced.

Moreover, in forming the antenna device 90 inside the metallic case body 81, it is desirable that a predetermined clearance should be stably provided between the chip antenna 91 or a printed antenna 99 as an antenna element and the metallic case body 81 since antenna gain delicately changes according to the positional relation between these two components. In the embodiment, the fixed ring-shape middle frame 86 is arranged between the movement 125 and the metallic case body 81, and the movement 125 is fixed to the middle frame 86. That is, the movement 125 is attached to the metallic case body 81 via the middle frame 86. Thus, the chip antenna 91 or the printed antenna 99 as an antenna element formed on the second substrate 135 is fixed with a predetermined clearance to the outer circumference of the case. Therefore, variance in antenna gain is restrained and ease of assembly can be improved.

FIG. 6 shows an example of properties of the antenna device 90 according to the embodiment of the invention. In FIG. 6, the axes on the radar chart express relative values of antenna gain in decibels, and a greater value indicates greater antenna gain.

Figure 11A:
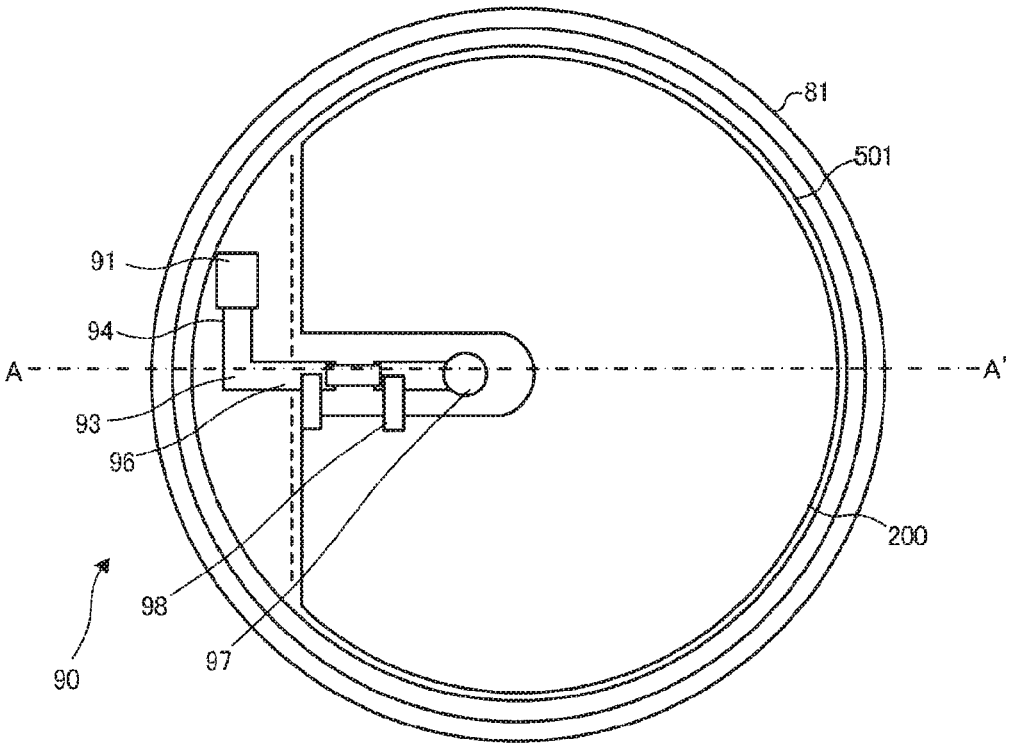
FIG. 11A is a plan view of an antenna device of an electronic timepiece according to a comparative example.
Figure 11B:
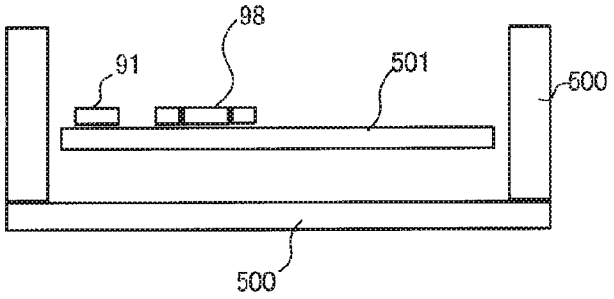
FIG. 11B is a cross-sectional view taken along A-A' in FIG. 11A.

FIG. 6 shows an example of properties of the antenna device 90 according to the embodiment of the invention with the metallic back cover 85 installed thereon, an example of properties of the antenna device 90 according to the embodiment of the invention without the metallic back cover 85 installed thereon, and an example of properties of an antenna device in an electronic timepiece according to a comparative example using a plastic case shown in FIGS. 11A and 11B.

In the comparative example shown in FIGS. 11A and 11B, a plastic case 500 is used as the case, and the chip antenna 91, the matching element 98, the power feeding pattern 96, and the power feeding point 97 are formed on a single circuit board 501.

As shown in FIG. 6, in the case where the metallic back cover 85 is not installed on the antenna device 90 according to the embodiment of the invention, it can be seen that good properties are achieved, as the area formed by the lines in the radar chart showing properties is greater than in the case of the antenna device on the circuit board 501 in the plastic case 500 according to the comparative example.

Meanwhile, in the case where the metallic back cover 85 is installed, though the properties deteriorate compared with the case where the back cover 85 is not installed, it can be said that an area substantially equal to that expressed by the properties of the antenna device in the comparative example is achieved. That is, it can be understood that, regardless of whether the metallic back cover 85 is used or not, the antenna device 90 according to the embodiment of the invention can achieve properties equivalent to those of the antenna device in the comparative example, which does not use the metallic back cover 85.

Also, the antenna device 90 according to the embodiment of the invention has the following advantages. That is, according to the embodiment, the ground pattern 200 and the wireless communication unit 23 as the power feeding circuit are formed on the first substrate 145, and the chip antenna 91 as an antenna element is arranged on the second substrate 135, thus enabling the configuration of the three-dimensional antenna device. Therefore, a basic antenna element such as the chip antenna 91 can be used as the antenna element formed on the second substrate 135.

Also, in forming the antenna device 90 inside the metallic case body 81, it is desirable that a predetermined clearance should be stably provided between the chip antenna 91 as an antenna element, and the metallic case body 81 and the back cover 85, since antenna gain delicately changes according to the positional relation between these components. In the embodiment, the first substrate 145 and the second substrate 135 are attached in such a way as to sandwich the movement 125, and the movement 125 is positioned on the case body 81 via the middle frame 86. Therefore, the chip antenna 91 as an antenna element formed on the second substrate 135 is fixed with a predetermined clearance to the case body 81. Thus, variance in antenna gain is restrained and ease of assembly is improved as well.

In the embodiment, since no ground pattern is provided on the second substrate 135, the degree of freedom in the layout on the second substrate 135 can be improved. That is, the chip antenna 91 as an antenna element, the power feeding pattern 94 and the connecting point 93 alone may be arrange don the second substrate 135, or another circuit pattern may be formed in parts other than the chip antenna 91 and the like on the second substrate 135. Alternatively, even if another component such as a metal plate is arranged in other parts than the chip antenna 91 and the like on the second substrate 135, a good antenna device without having large deterioration in antenna properties can be provided.

Second Embodiment

Figure 7A:
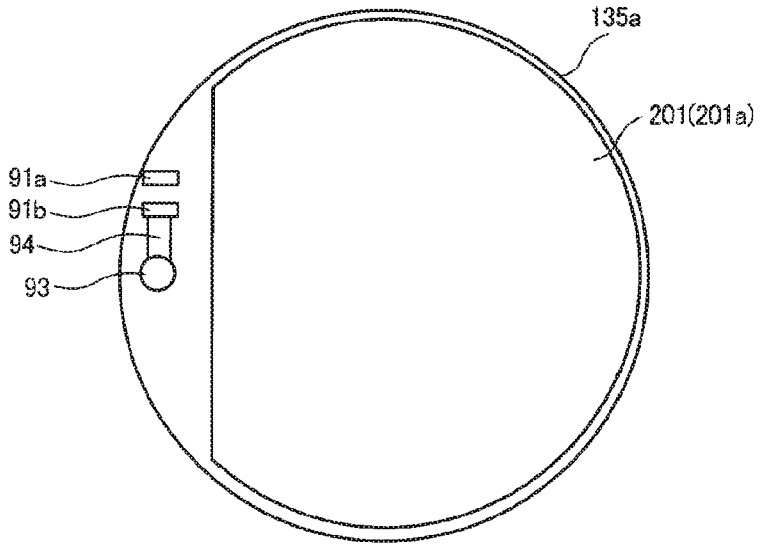
FIG. 7A is a plan view showing the face side of a second substrate of an antenna device according to a second embodiment.
Figure 7B:
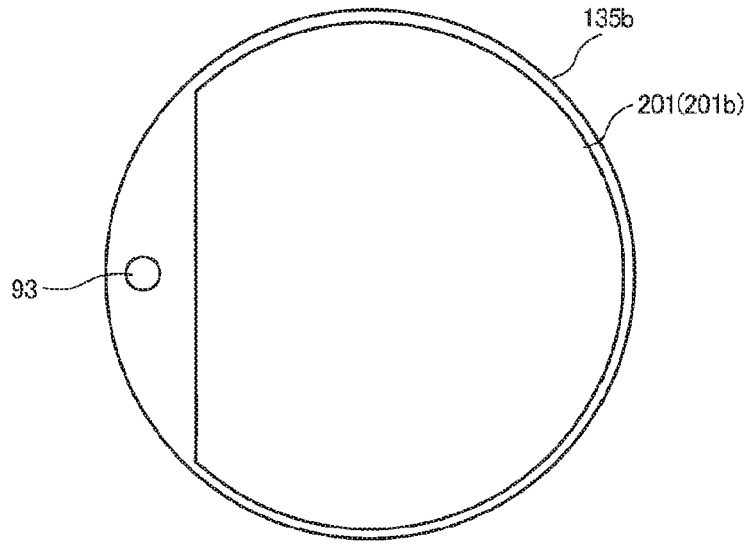
FIG. 7B is a plan view showing the back side of the second substrate of the antenna device according to the second embodiment.
Figure 7C:
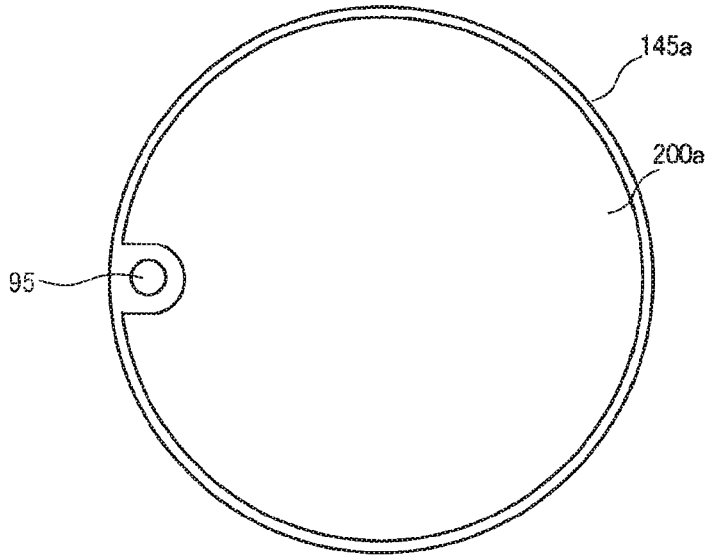
FIG. 7C is a plan view showing the face side of a first substrate of the antenna device according to the second embodiment.
Figure 7D:
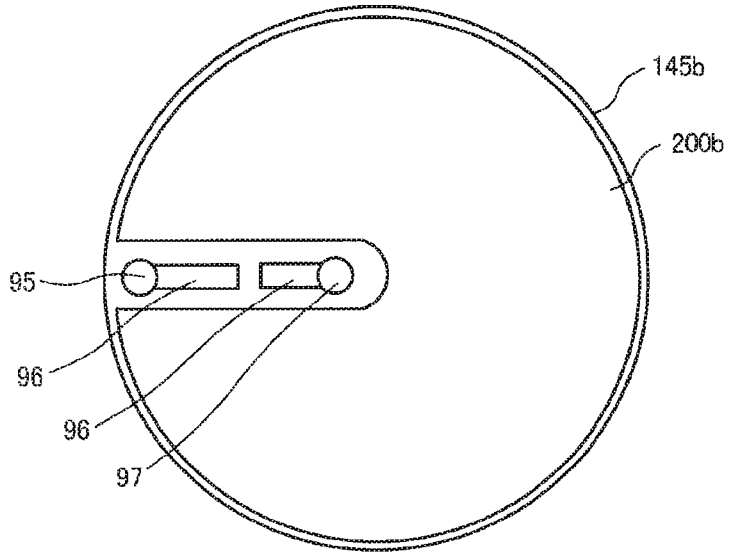
FIG. 7D is a plan view showing the back side of the first substrate of the antenna device according to the second embodiment.

Next, a second embodiment of the invention will be described, referring to FIGS. 7A to 7D. In this embodiment, a ground pattern 201 (face-side ground pattern 201*a*, back-side ground pattern 201*b*) is formed on the second substrate 135 as shown in FIGS. 7A and 7B.

The face-side ground pattern 201*a* is formed with a predetermined distance maintained from the chip antenna 91 as an antenna element.

Meanwhile, on the first substrate 145, the area of the ground pattern 200 (face-side ground pattern 200*a*, back-side ground pattern 200*b*) is made greater than in the first embodiment. The ground pattern 201 on the second substrate 135 and the ground pattern 200 on the first substrate 145 are electrically continued.

That is, in the first substrate 145 as a multilayer substrate, the ground pattern 200 is formed on each layer of the first substrate 145, and the ground pattern 200 formed on each layer is formed substantially in the entire area of the substrate, except the wireless communication unit 23 as the power feeding circuit, and the power feeding point 97, which is the connecting part between the wireless communication unit 23 as the power feeding circuit and the conductive electrode 92.

According to this embodiment, the chip antenna 91 as an antenna element and the conductive electrode 92 on the second substrate 135 are arranged with a three-dimensional configuration on the ground pattern 200 on the first substrate 145 and the ground pattern 201 on the second substrate 135, which are formed three-dimensionally, and thus operate as a three-dimensional monopole. Therefore, the influence of the metallic back cover 85 is reduced further.

Also, since the areas of the ground patterns are greater than in the first embodiment, the directionality of the antenna can be close to ideal.

Third Embodiment

Next, a third embodiment of the invention will be described, referring to FIGS. 8A to 10. In this embodiment, a quarter-wavelength printed antenna 99 is used as an antenna element, as shown in FIGS. 8A to 8D and FIGS. 9A to 9D. The printed antenna 99 is a pattern formed of an electrically conductive material and can be manufactured easily.

Figure 8A:
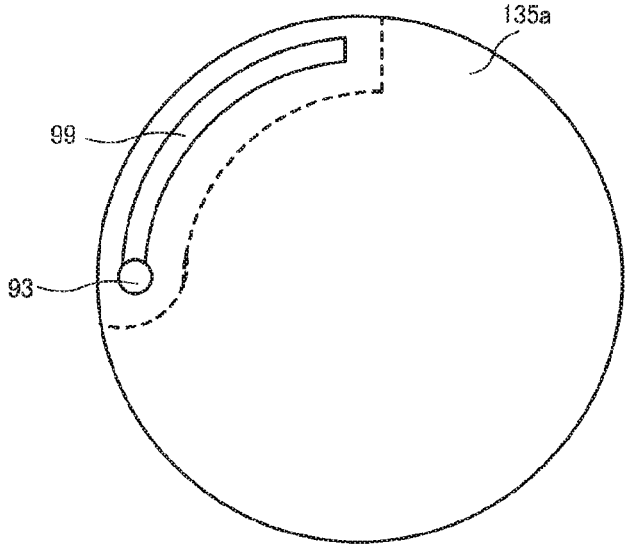
FIG. 8A is a plan view showing the face side of a second substrate of an antenna device according to a third embodiment.
Figure 8B:
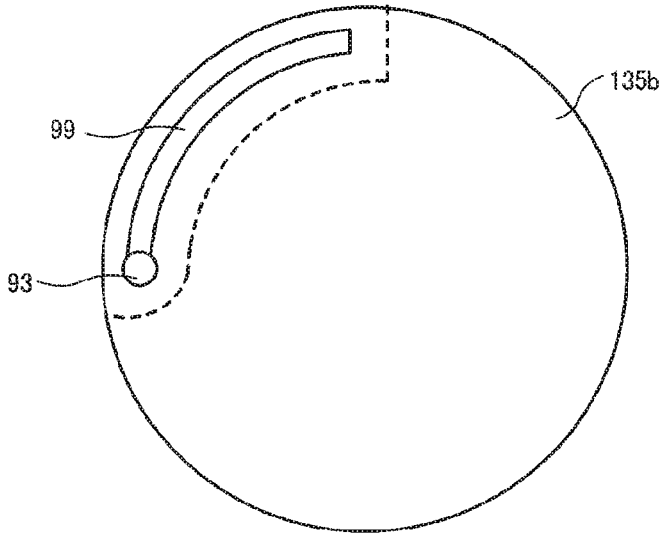
FIG. 8B is a plan view showing the back side of the second substrate of the antenna device according to the third embodiment.
Figure 8C:
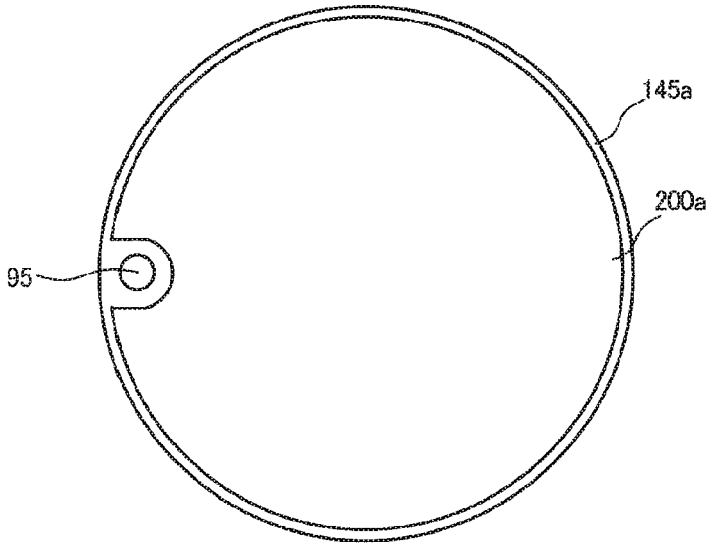
FIG. 8C is a plan view showing the face side of a first substrate of the antenna device according to the third embodiment.
Figure 8D:
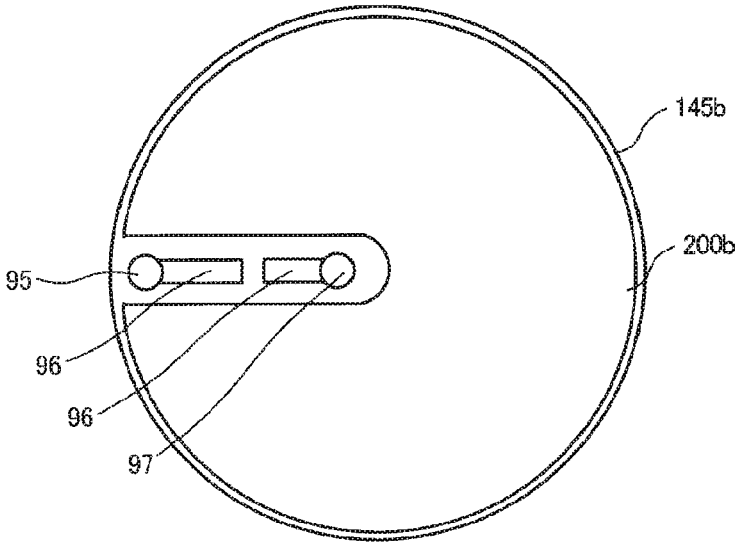
FIG. 8D is a plan view showing the back side of the first substrate of the antenna device according to the third embodiment.
Figure 9A:
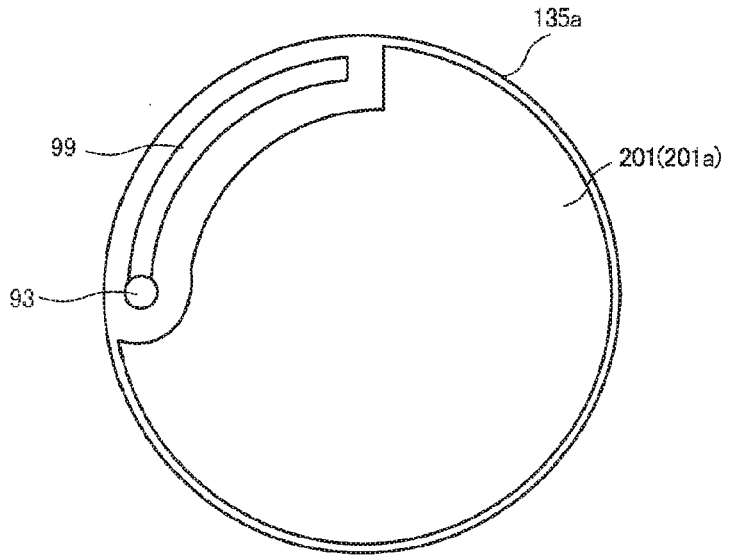
FIG. 9A is a plan view showing the face side of the second substrate of the antenna device according to the third embodiment.
Figure 9B:
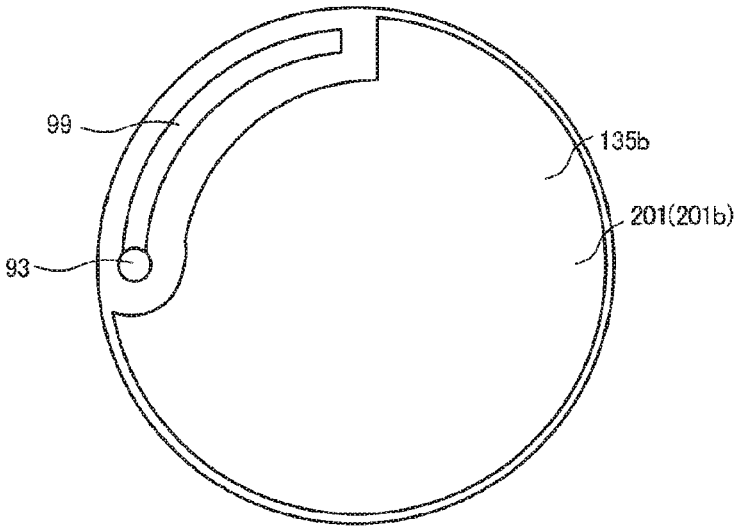
FIG. 9B is a plan view showing the back side of the second substrate of the antenna device according to the third embodiment.
Figure 9C:
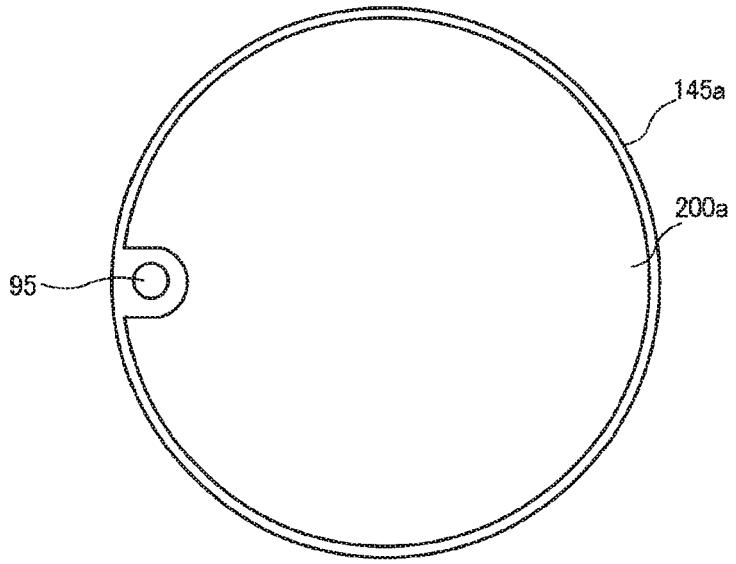
FIG. 9C is a plan view showing the face side of the first substrate of the antenna device according to the third embodiment.
Figure 9D:
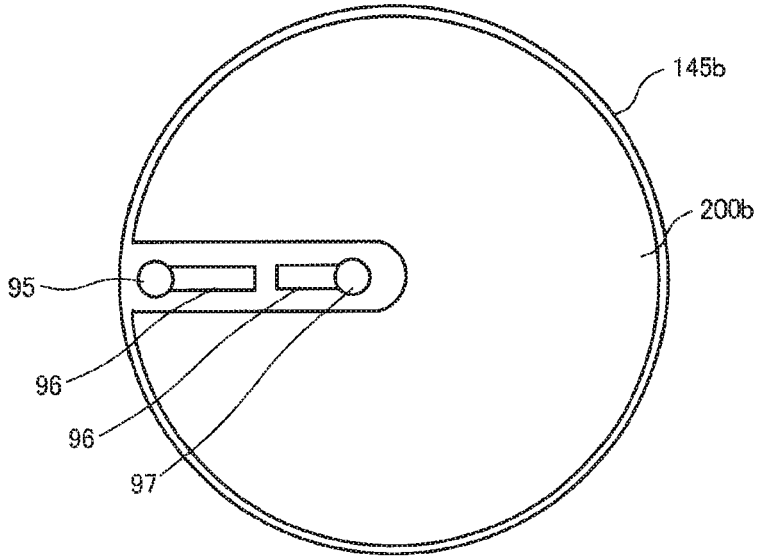
FIG. 9D is a plan view showing the back side of the first substrate of the antenna device according to the third embodiment.

Also in the case where the printed antenna 99 is used, a configuration in which no ground pattern is provided on the second substrate 135 may be used, as shown in FIGS. 8A and 8B, or a configuration in which the ground pattern 201 is provided on the second substrate 135 may be used, as shown in FIGS. 9A and 9B.

Figure 10:
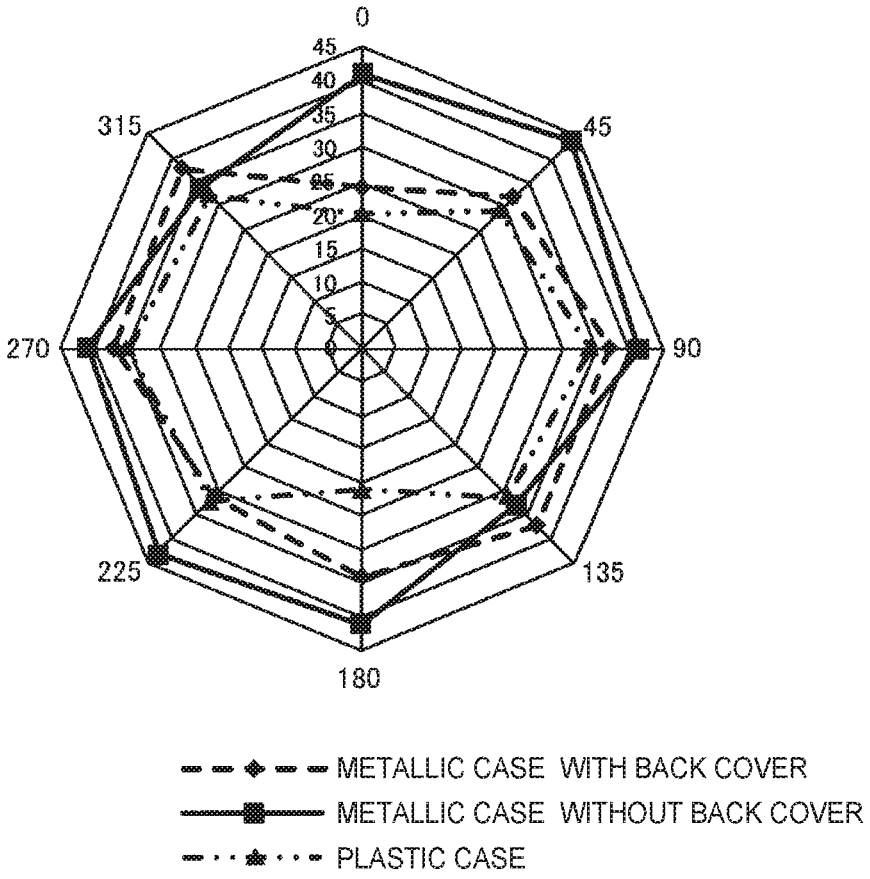
FIG. 10 shows an example of properties of the antenna device according to the third embodiment.

FIG. 10 shows an example of properties of the antenna device 90 in the case where the ground pattern 201 is provided on the second substrate 135, as shown in FIGS. 9A and 9B. As shown in FIG. 10, even in the case where the printed antenna 99 is used, it can be understood that, while there are some changes similar to those in the first embodiment due to the presence or absence of the metallic back cover 85, properties substantially equivalent to those of the antenna device in the plastic case 500 in the comparative example are achieved.

That is, by using the antenna device according to the embodiment of the invention, even in the case where the metallic case body 81, the metallic back cover 85 and metallic mechanical components forming gears and the like exist in the electronic timepiece 100, good antenna properties with less deterioration in antenna gain can be achieved similarly to the comparative example having the plastic case 500.

Modifications

The invention is not limited to the above embodiments. Various modifications can be made as follows, for example. Also, any one or a plurality of modifications selected from the modifications below can be combined according to need.

Modification 1

The ground patterns 200, 201 in the embodiments may have an electric potential equal to the positive potential or negative potential of the battery 130 in the electronic timepiece 100. Thus, the ground potential inside the circuit of the electronic timepiece 100 can be stabilized with a simple configuration.

Modification 2

While the invention is applied to an analog-type electronic timepiece in the above embodiments and modification, the invention can also be applied to electronic timepieces such as table clock or wall clock.

The functions according to the invention may be realized, for example, by incorporating a program in a computer having a CPU (central processing unit), a memory (storage device) and the like. This program may be installed via communication measures such as the internet or via recording media such as CD-ROM and memory card.

While wireless communication according to the Bluetooth (trademark registered) standard is used as an example of near-field wireless communications in the above embodiments and modifications, the invention is not limited such a configuration and can also be applied to cases where WiFi (trademark registered) and other types of near-field wireless communications are used.

The entire disclosure of Japanese Patent Application No. 2015-026181, filed Feb. 13, 2015 is expressly incorporated by reference herein.

What is claimed is:

1. An antenna device housed in a metallic case of an electronic timepiece, the antenna device comprising:

a first substrate which is arranged between a movement of the electronic timepiece arranged inside the metallic case and a back cover of the metallic case and on which a ground pattern and a power feeding circuit are formed;

a second substrate which is attached to the movement and arranged at a position sandwiching the movement of the electronic timepiece with the first substrate and being disposed between the movement and a disc-like face;

an antenna element formed on the second substrate; and a conductive electrode which is arranged inside the movement and extends through the first substrate and the second substrate, the conductive electrode having one end connected to the power feeding circuit and the other end connected to the antenna element.

2. The antenna device according to claim 1, wherein on the second substrate, a ground pattern is formed with a predetermined distance maintained from the antenna element, and the ground pattern on the second substrate is electrically continued to the ground pattern on the first substrate.

3. The antenna device according to claim 1, wherein the first substrate includes a plurality of layers, and the ground pattern on the first substrate is formed on at least one layer of the first substrate and formed in the entire area of the first substrate except the power feeding circuit and a connecting part between the power feeding circuit and the conductive electrode.

4. The antenna device according to claim 1, wherein the ground pattern is connected to a positive electrode or a negative electrode of a battery of the electronic timepiece.

5. The antenna device according to claim 1, wherein the movement is attached to the metallic case via a middle frame.

6. The antenna device according to claim 5, wherein the middle frame is positioned by a dial ring.

7. The antenna device according to claim 1, wherein the antenna element is a chip antenna.

8. The antenna device according to claim 1, wherein the antenna element is a printed pattern.

9. The electronic timepiece comprising the antenna device according to claim 1, wherein the electronic timepiece is one of an analog electronic timepiece, a table clock and a wall clock.

* * * * *